US010734747B2

(12) United States Patent
Li et al.

(10) Patent No.: US 10,734,747 B2
(45) Date of Patent: Aug. 4, 2020

(54) POWER INTERFACE, MOBILE TERMINAL, AND ELECTRONIC DEVICE

(71) Applicant: GUANGDONG OPPO MOBILE TELECOMMUNICATIONS CORP., LTD., Dongguan, Guangdong (CN)

(72) Inventors: Feifei Li, Dongguan (CN); Guodong Gu, Dongguan (CN)

(73) Assignee: GUANGDONG OPPO MOBILE TELECOMMUNICATIONS CORP., LTD, Dongguan, Guangdong (CN)

( * ) Notice: Subject to any disclaimer, the term of this patent is extended or adjusted under 35 U.S.C. 154(b) by 0 days.

(21) Appl. No.: 16/235,097

(22) Filed: Dec. 28, 2018

(65) Prior Publication Data

US 2019/0157794 A1 May 23, 2019

Related U.S. Application Data

(63) Continuation-in-part of application No. PCT/CN2017/081268, filed on Apr. 20, 2017.

(30) Foreign Application Priority Data

Jul. 27, 2016 (CN) ..... 2016 2 0806884 U

(51) Int. Cl.
*H01R 24/60* (2011.01)
*H01R 13/502* (2006.01)
(Continued)

(52) U.S. Cl.
CPC ..... *H01R 13/502* (2013.01); *H01R 12/55* (2013.01); *H01R 13/26* (2013.01); *H01R 13/504* (2013.01);
(Continued)

(58) Field of Classification Search
CPC ..... H01R 24/60; H01R 12/722
(Continued)

(56) References Cited

U.S. PATENT DOCUMENTS 9,343,840 B2 5/2016 Fukami et al.
9,537,263 B2 * 1/2017 Gao ..... H01R 13/6582
(Continued)

FOREIGN PATENT DOCUMENTS

CN 102683984 A 9/2012
CN 203277778 U 11/2013
(Continued)

OTHER PUBLICATIONS

International Search Report for PCT/CN2017/081268 dated Aug. 1, 2017.
(Continued)

*Primary Examiner* — Abdullah A Riyami
*Assistant Examiner* — Justin M Kratt
(74) *Attorney, Agent, or Firm* — Ladas & Parry, LLP

(57) ABSTRACT

A power interface, a mobile terminal, and an electronic device are disclosed. The power interface includes a housing and a connection body. The housing includes a perimeter wall defining an opening. The connection body is disposed in the housing, one end of the connection body extends out of the housing from the opening, and located outside the housing. The perimeter wall comprises a pair of arc sections located at two ends of the perimeter wall and spaced apart from each other in a length direction.

20 Claims, 5 Drawing Sheets

(51) Int. Cl.

| | |
|---|---|
| ***H01R 13/504*** | (2006.01) |
| ***H01R 12/55*** | (2011.01) |
| ***H01R 13/26*** | (2006.01) |
| ***H01R 13/52*** | (2006.01) |
| *H01R 12/71* | (2011.01) |
| *H01R 13/02* | (2006.01) |
| *H01R 13/6587* | (2011.01) |
| *H01R 12/72* | (2011.01) |
| *H01R 13/642* | (2006.01) |
| *H01R 13/66* | (2006.01) |
| *H01R 13/73* | (2006.01) |
| *H01R 107/00* | (2006.01) |

(52) U.S. Cl.
CPC ..... *H01R 13/5219* (2013.01); *H01R 24/60* (2013.01); *H01R 12/716* (2013.01); *H01R 12/722* (2013.01); *H01R 12/724* (2013.01); *H01R 13/02* (2013.01); *H01R 13/52* (2013.01); *H01R 13/642* (2013.01); *H01R 13/6587* (2013.01); *H01R 13/6658* (2013.01); *H01R 13/73* (2013.01); *H01R 2107/00* (2013.01)

(58) Field of Classification Search
USPC ..... 439/660, 676
See application file for complete search history.

(56) References Cited

U.S. PATENT DOCUMENTS

| | | | | |
|---|---|---|---|---|
| 2015/0162684 | A1 | 6/2015 | Amini et al. | |
| 2017/0365951 | A1* | 12/2017 | Zhang | H01R 24/60 |
| 2018/0358736 | A1* | 12/2018 | Gu | H01R 43/16 |
| 2019/0157791 | A1* | 5/2019 | Gu | H01R 13/405 |
| 2019/0165510 | A1* | 5/2019 | Li | H01R 13/5045 |
| 2019/0296471 | A1* | 9/2019 | Gu | H01R 12/55 |
| 2019/0296475 | A1* | 9/2019 | Li | H01R 13/502 |

FOREIGN PATENT DOCUMENTS

| | | | |
|---|---|---|---|
| CN | 203553401 | U | 4/2014 |
| CN | 204030182 | U | 12/2014 |
| CN | 204424499 | | 6/2015 |
| CN | 105375157 | A | 3/2016 |
| CN | 205282692 | U | 6/2016 |
| CN | 205882260 | | 1/2017 |
| WO | WO2015073974 | A2 | 5/2015 |

OTHER PUBLICATIONS

Written Opinion for PCT/CN2017/081268 dated Aug. 1, 2017.
European search report, EP17833261.5, dated Jun. 13, 2019 (8 pages).
Indian First Examination Report, Indian patent Application 201917005213, dated Sep. 3, 2020 (5 pages).

* cited by examiner

POWER INTERFACE, MOBILE TERMINAL, AND ELECTRONIC DEVICE

CROSS REFERENCE TO RELATED APPLICATIONS

The present application is a continuation-in-part of International (PCT) Patent Application No. PCT/CN2017/081268 filed Apr. 20, 2017, which claims foreign priority of Chinese Patent Application No. 201620806884A, filed on Jul. 27, 2016, the entire contents of which are hereby incorporated by reference in their entireties.

TECHNICAL FIELD

The described embodiments relate to communication technology, and in particular to a power interface, a mobile terminal, and an electronic device.

BACKGROUND

With the continuous improvement of living conditions, mobile terminals (such as mobile phones) have become essential communication tools for people. In order to meet the requirements of users and improve the market competitiveness of the mobile terminals, on one hand, researchers and developers continue to improve the performance of mobile terminals; on the other hand, researchers and developers continue to improve and optimize the appearance of mobile terminals. Power interfaces are important components for the mobile terminals. On one hand, when charging the mobile terminals, the power interfaces are required for charging the mobile terminals; on the other hand, data transmission between the mobile terminals and other devices is achieved by the power interfaces. However, during a long-term use, impurities and chippings may enter the power interfaces, and may be difficult to clean. In this way, the charging and data transmission performances of the mobile terminals are affected, and failures will even occur. Besides, the power interfaces will get loose since connectors are frequently inserted into the mobile terminals and removed from the mobile terminals, which results in an unstable connection, and the service lives of the batteries and the mobile terminals are also affected. In addition, the power interfaces are disposed at outer sides of the mobile terminals, which has an important influence on the appearances of the mobile terminals.

SUMMARY

According to an aspect of the present disclosure, a power interface may be provided. The power interface may include a housing and a connection body. The housing may include a perimeter wall defining an opening. The perimeter wall may include a pair of arc sections located at two ends of the perimeter wall and spaced apart from each other in a length direction. The connection body may be disposed in the housing. One end of the connection body may extend out of the housing from the opening and be exposed outside the housing.

According to another aspect, a mobile terminal is further provided. The mobile terminal may include a circuit board, a housing, and a connection body. The housing may include a perimeter wall defining an opening. The perimeter wall may include a pair of arc sections located at two ends of the perimeter wall and spaced apart from each other in a length direction. The connection body may be disposed in the housing. One end of the connection body may extend out of the housing from the opening and be exposed outside the housing.

According to a further aspect, an electronic device may be provided. The electronic device may include a circuit board and a power interface configured to be connected to the circuit board. The power interface may include a housing, and a connection body. The housing may include a perimeter wall defining an opening. The perimeter wall may include a pair of arc sections located at two ends of the perimeter wall and spaced apart from each other in a length direction. The perimeter wall may further include a pair of straight sections respectively connected between the pair of arc sections at two opposite ends of each arc section. The connection body may be disposed in the housing. One end of the connection body may extend out of the housing from the opening and be exposed outside the housing.

BRIEF DESCRIPTION OF THE DRAWINGS

The above and/or additional aspects and advantages of the present disclosure will become apparent and readily understood in the description of the embodiments with reference to the drawings described below.

DETAILED DESCRIPTION

Figure 1:
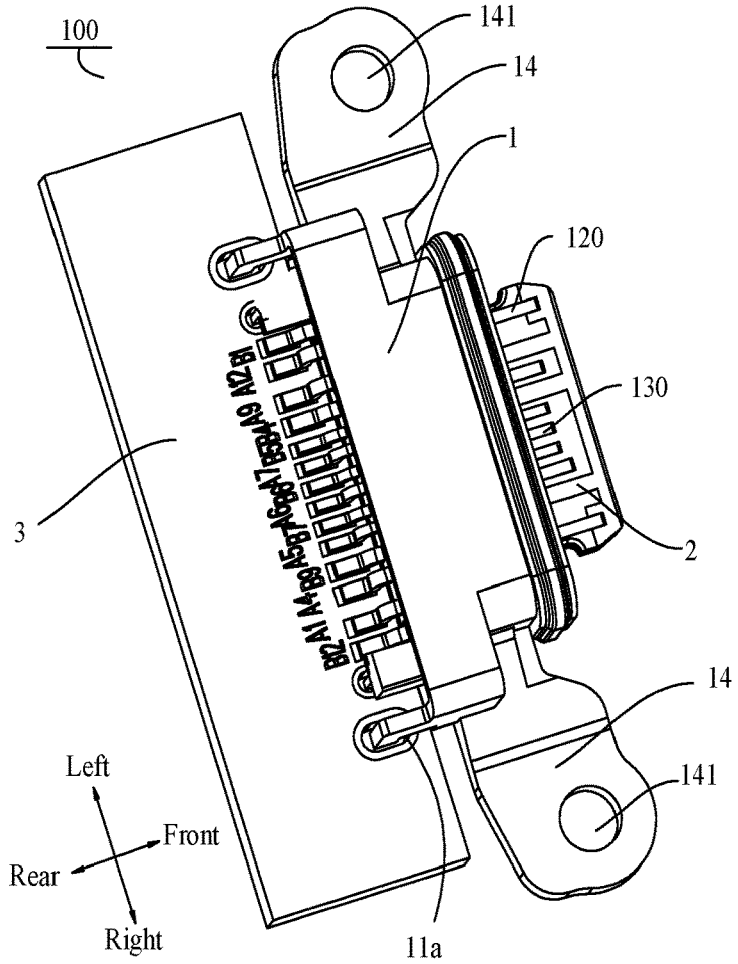
FIG. 1 is a perspective view of a power interface according to some embodiments of the present disclosure.

Embodiments of the present disclosure will be described in detail below, and examples of the embodiments will be illustrated in the accompanying drawings. The embodiments described below with reference to the drawings are illustrative and are intended to explain the present disclosure, and cannot be construed as a limitation to the present disclosure.

In the description of the present disclosure, it is to be understood that terms such as "center", "width", "thickness", "up", "down", "front", "rear", "left", "right", "inner", "outer", "circumference", and the like, refer to the orientations and locational relations illustrated in the accompanying drawings. Thus, these terms used here are only for describing the present disclosure and for describing in a simple manner, and are not intended to indicate or imply that the device or the elements are arranged to locate at the specific directions or are structured and performed in the specific directions, which could not to be understood as limiting the present disclosure.

In addition, terms such as "first", "second", and the like are used herein for purposes of description, and are not intended to indicate or imply relative importance or significance or to imply the number of indicated technical features. Thus, the feature defined with "first", "second", and the like may include one or more of such a feature. In the description of the present disclosure, "a plurality of" means two or more, such as two, three, and the like, unless specified otherwise.

In the present disclosure, unless specified or limited, otherwise, terms "mounted", "connected", "coupled", "fixed", and the like are used in a broad sense, and may include, for example, fixed connections, detachable connections, or integral connections; may also be mechanical or electrical connections; may also be direct connections or indirect connections via intervening structures: may also be inner communications of two elements, as can be understood by one skilled in the art depending on specific contexts.

According to an aspect of the present disclosure, a power interface may be provided. The power interface may include a housing and a connection body. The housing may include a perimeter wall defining an opening. The perimeter wall may include a pair of arc sections located at two ends of the perimeter wall and spaced apart from each other in a length direction. The connection body may be disposed in the housing. One end of the connection body may extend out of the housing from the opening and be exposed outside the housing.

In some embodiments, each of the pair of arc sections may be in shape of a semi-circle.

In some embodiments, a center of curvature of each arc section may be located in the opening.

In some embodiments, the perimeter wall may further include a pair of straight sections respectively connected between the pair of arc sections at two s opposite ends of each arc section, and the pair of straight sections may be substantially parallel to each other.

In some embodiments, the housing may include a first end connected to a circuit board, and a second end away from the first end. A chamfer may be formed between an inner wall of the perimeter wall and an end face at the second end of the perimeter wall, and the chamfer may extend along a circumference of the perimeter wall.

In some embodiments, the chamfer may include a first edge connected to the end face and a second edge connected to the inner wall. A minimum distance from the first edge to the circuit board may be greater than a minimum distance from the second edge to the circuit board.

In some embodiments, the power interface may further include a plurality of data pins and a plurality of power pins. The plurality of data pins may be spaced apart from each other and connected to the connection body. The plurality of power pins may be spaced apart from each other and connected to the connection body. The plurality of data pins and the plurality of power pins may be exposed outside the connection body.

In some embodiments, the power interface may further include a first stopping plate configured to stop the connection body and a second stopping plate spaced apart from the first stopping plate in a length direction of each of the plurality of power pins. The first stopping plate and the second stopping plate may be arranged in the housing. A part of the connection body may be located between the first stopping plate and the second stopping plate.

In some embodiments, the power interface may further include a plurality of first stopping plates and a plurality of second stopping plates. The plurality of first stopping plates may be spaced apart from each other in a circumferential direction of the housing, and the plurality of second stopping plates may be spaced apart from each other in the circumferential direction of the housing.

In some embodiments, a wing may be arranged on the power interface, and the wing defines a screw hole.

In some embodiments, at least one of the plurality of power pins may include an expanded portion having a cross-sectional area larger than that of each of the plurality of data pins.

In some embodiments, front end faces respectively of the first stopping plate and the second stopping plate are flat planes.

In some embodiments, at least one of the plurality of power pins comprises an expanded portion, wherein the expanded portion has a cross-sectional area S, and the cross-sectional area S satisfies: $S \leq 0.09805\ mm^2$.

In some embodiments, each of the plurality of power pins has a thickness D, and the thickness D satisfies: $0.1\ mm \leq D \leq 0.3\ mm$.

In some embodiments, the free end is located in the middle of the opening.

According to another aspect, a mobile terminal is further provided. The mobile terminal may include a circuit board, a housing, and a connection body. The housing may include a perimeter wall defining an opening. The perimeter wall may include a pair of arc sections located at two ends of the perimeter wall and spaced apart from each other in a length direction. The connection body may be disposed in the housing. One end of the connection body may extend out of the housing from the opening and be exposed outside the housing.

According to a further aspect, an electronic device may be provided. The electronic device may include a circuit board and a power interface configured to be connected to the circuit board. The power interface may include a housing, and a connection body. The housing may include a perimeter wall defining an opening. The perimeter wall may include a pair of arc sections located at two ends of the perimeter wall and spaced apart from each other in a length direction. The perimeter wall may further include a pair of straight sections respectively connected between the pair of arc sections at two opposite ends of each arc section. The connection body may be disposed in the housing. One end of the connection body may extend out of the housing from the opening and be exposed outside the housing.

In the following, a power interface 100 may be will be described in embodiments of the present disclosure with reference to FIGS. 1-7.

As shown in FIGS. 1-7, the power interface 100 according to some embodiments of the present disclosure may include a housing 1 and a connection body 2.

More specifically, the housing 1 may include a perimeter wall 11 defining an opening 10, and may include a first end 11*a* connected to a circuit board 3 and a second end 11*b* away from the first end 11*a*. The connection body 2 may be disposed in the housing 1. One end of the connection body 2 may extend out of the housing 1 from the opening 10 and exposed outside the housing 1. The perimeter wall 11 may include a pair of arc sections 110, and the pair of arc sections 110 may be located at two ends of the perimeter wall 11 and spaced apart from each other in a length direction (the left-right direction as shown in FIG. 1) of the power interface 100. It should be noted that, the power interface 100 may arranged in a mobile terminal, and a battery may be arranged inside the mobile terminal (e.g., a mobile phone, a tablet computer, a notebook computer, etc.). An external power source may be connected to the power interface 100 via a connector, and thus the battery may be charged by the external power source. In some embodiments, the connector may be a data line having an adapter adapted to the power interface.

In the power interface 100 according to some embodiments of the present disclosure, the perimeter wall 11 may include a pair of arc sections 110. In this way, on one hand, the power interface 100 may have a smooth transition at the junction that is connected to the connector, and a contact area between the power interface and the connector may be increased. In this way, the power interface 100 may be connected to the connector more stably and reliably. Besides, the power interface 100 may have a good dustproof and waterproof performance after being connected to the connector, and thus the service life of the power interface 100 and in turn the service life of the mobile terminal may be extended. On the other hand, when the perimeter wall 11 includes a pair of arc sections 110, the power interface 100 may have a smooth transition at the junction that is connected, thereby improving the overall appearance of the product and the market competitiveness of the product.

Figure 2:
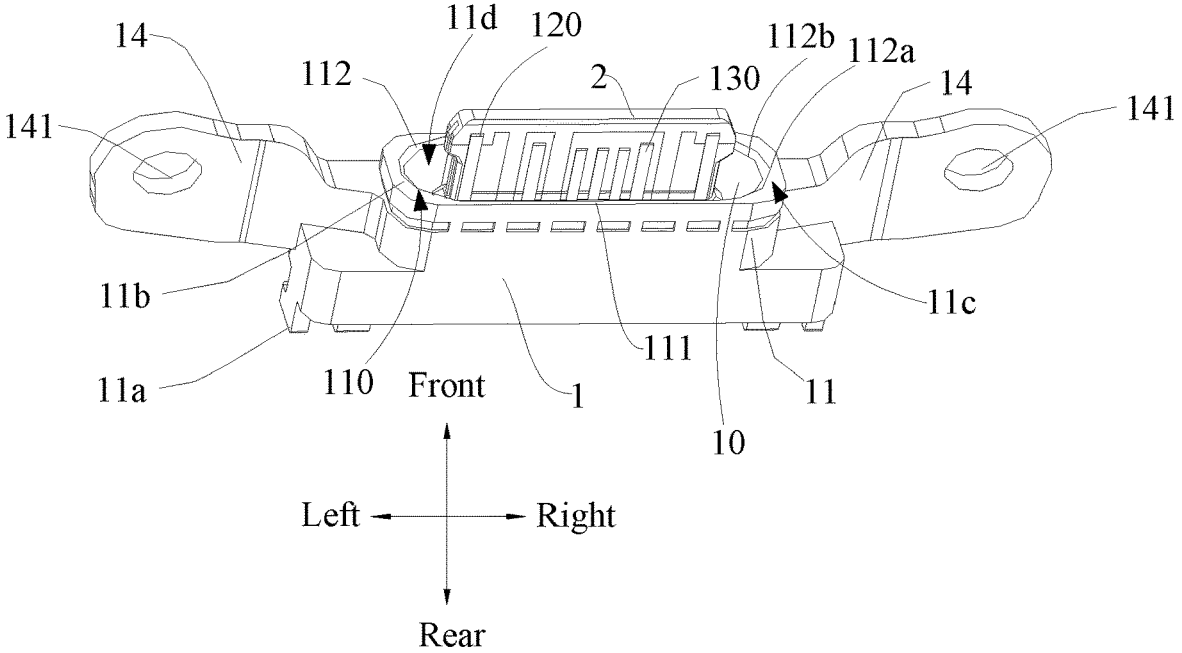
FIG. 2 is another perspective view of a power interface according to some embodiments of the present disclosure.

According to some embodiments of the present disclosure, as shown in FIG. 2, each arc section 110 may be in shape of a semi-circle. In this way, on one hand, the power interface 100 may have a smooth transition at the perimeter wall 11, such that it is convenient to connect the power interface 100 with the connector, and the arc section 110 in shape of a semi-circle may be easy to manufacture. On the other hand, since the arc section 110 is in shape of a semi-circle, thus the mobile terminal may have a smooth appearance, and the overall appearance of the product may be improved. In some embodiments of the present disclosure, as shown in FIG. 2, two ends of the power interface 100 in the left-right direction (the left-right direction as shown in FIGS. 1-4) may be respectively connected with one arc section 110 in shape of a semi-circle, and a cross section of the perimeter wall 11 may be in shape of a center-symmetrical runway. Besides, ends of each arc section 110 in shape of a semi-circle may be smoothly connected with the other portion of the perimeter wall 11.

Figure 3:
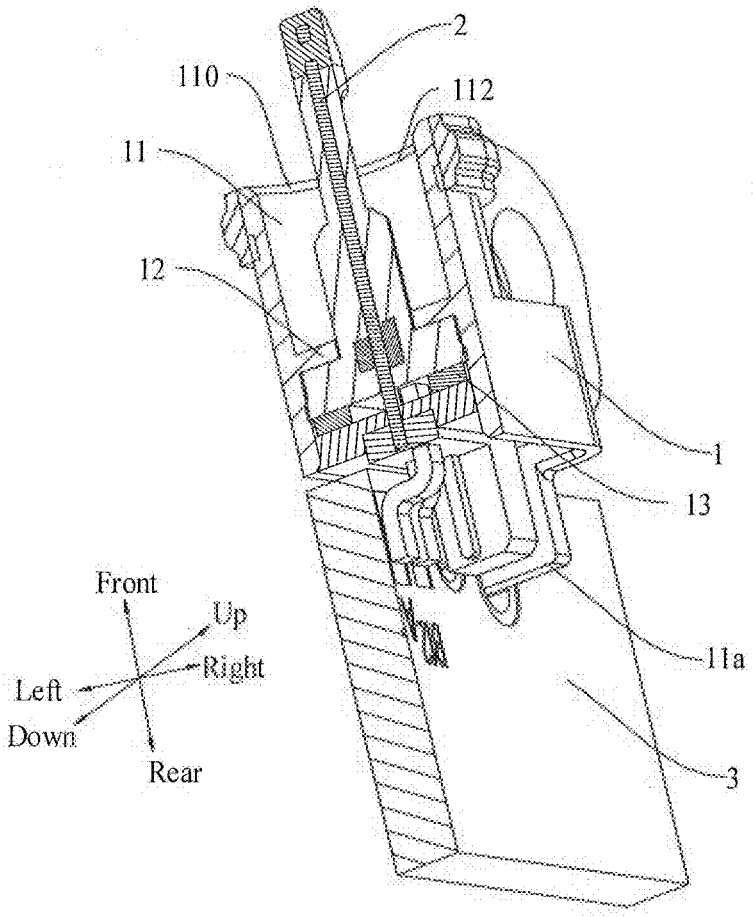
FIG. 3 is a cutaway view of the power interface according to some embodiments of the present disclosure.
Figure 4:
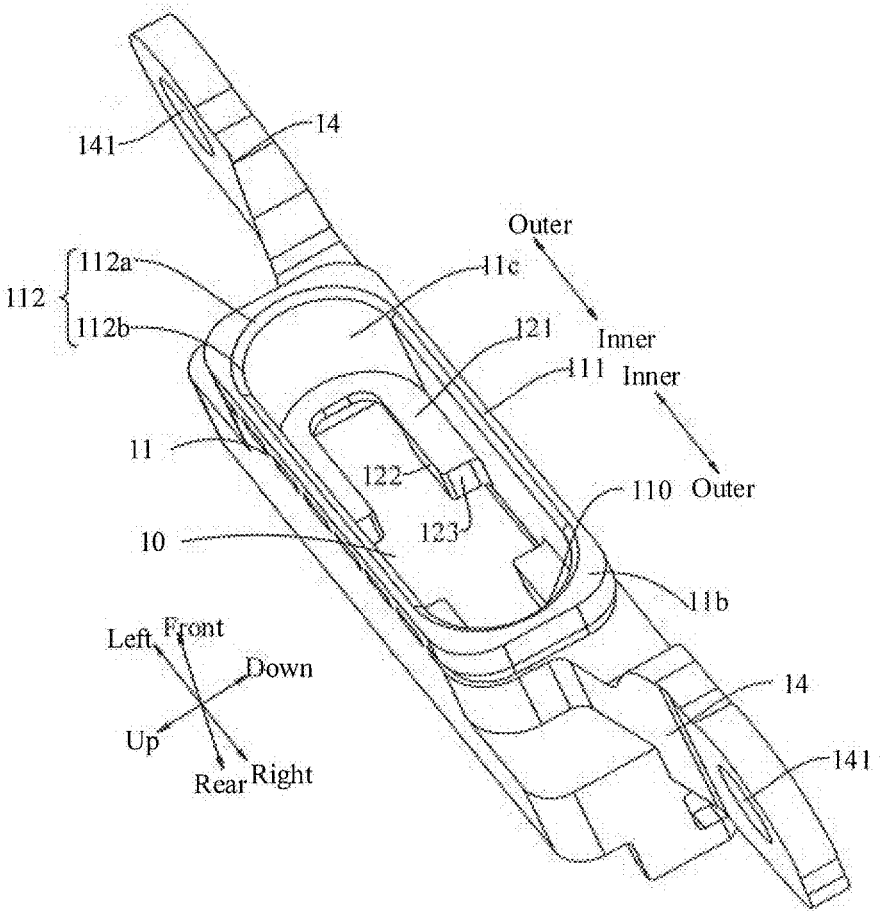
FIG. 4 is a partial view of the power interface according to some embodiments of the present disclosure.
Figure 5:
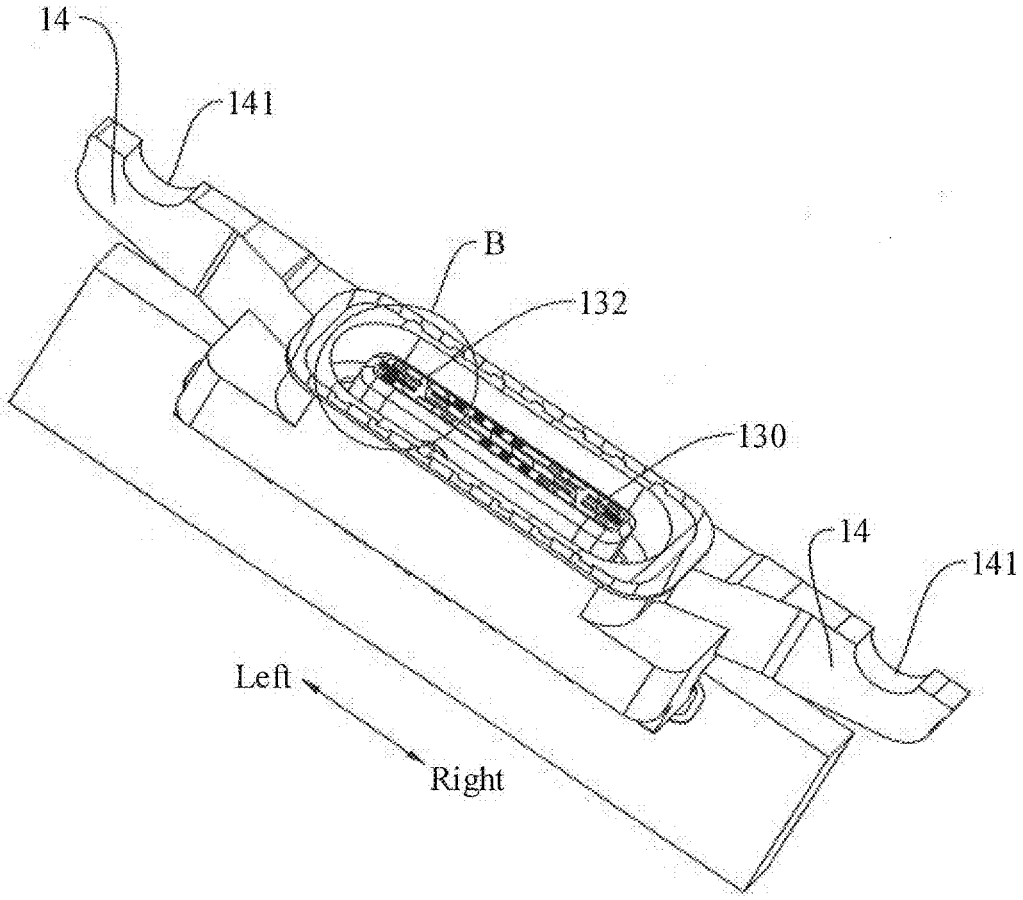
FIG. 5 is another cutaway view of the power interface according to some embodiments of the present disclosure.
Figure 6:
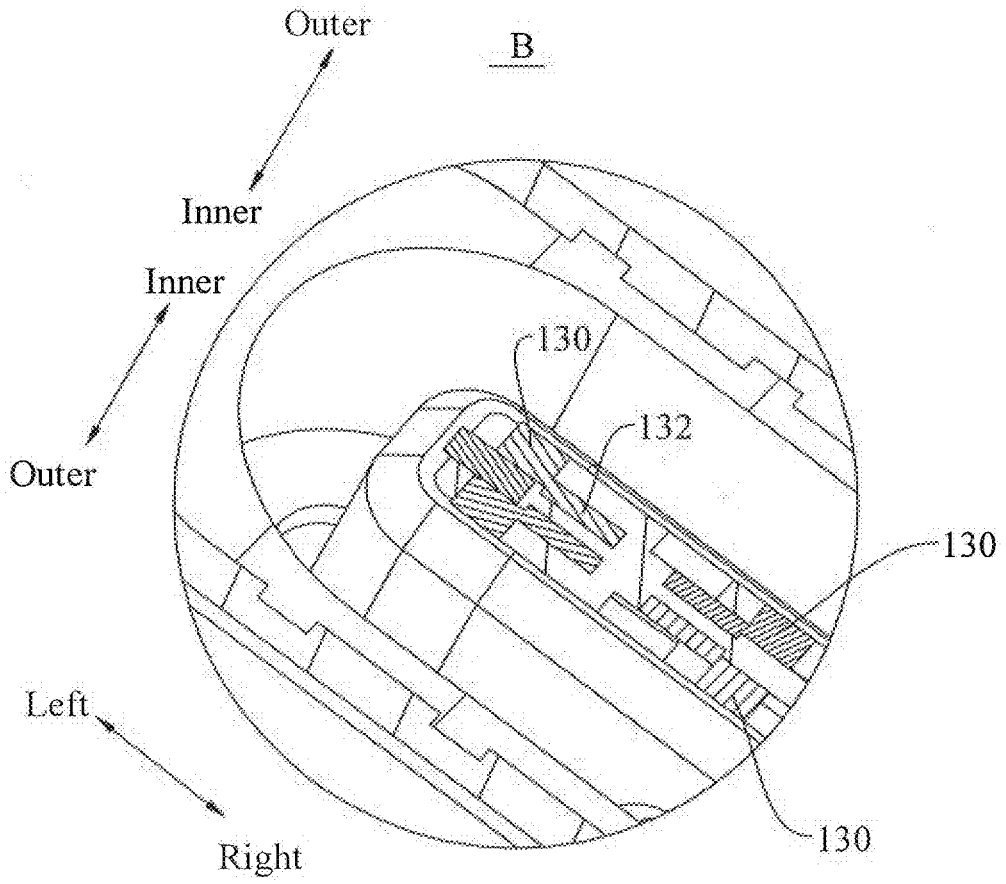
FIG. 6 is a partially enlarged view of portion B of FIG. 5.

According to some embodiments of the present disclosure, as shown in FIG. 2, each arc section 110 may be recessed toward an outer side of the opening 10 (the inner-outer direction as shown in FIG. 4). That is to say, a center of curvature of each arc section 110 may be located in the opening 10. In this way, the power interface 100 may form a smoothly transitioned interface, and thus it is convenient to connect the power interface 100 with the connector. As shown in FIG. 2, each arc section 110 in the left-right direction (the left-right direction as shown in FIGS. 1-4) may be in shape of a semi-circle recessed toward the outer side of the opening 10, that is to say, the semi-circular arc section may have a center of curvature located in the opening 10. In other embodiments of the present disclosure, each arc section 110 may also be recessed toward an inner side of the opening 10; that is to say, a center of curvature of each arc section may be located outside the housing 1.

According to an embodiment of the present disclosure, as shown in FIG. 2, the perimeter wall 11 may further include a pair of straight sections 111 respectively connected between the pair of arc sections 110 at two opposite ends of each arc section 110. In this way, it is convenient to connect the power interface 100 to the connector. Furthermore, in order to further improve the stability and reliability of the connection between the connector and the power interface 100, in some embodiments of the present disclosure, as shown in FIG. 14, the pair of straight sections 111 may be substantially parallel to each other. In this way, an upper face and a lower face of the perimeter wall 11 may be located in two planes parallel to each other. Thus, it is convenient to arrange a connection chip on the connection body 2, and the communication between the power interface and the connector may be more convenient.

According to some embodiments of the present disclosure, as shown in FIG. 2, a chamfer 112 may be formed at the perimeter wall 11. In this way, the power interface 100 may be more tightly connected to the connector, and the power interface 100 may have a good dustproof and waterproof performance. Besides, forming the chamfer 112 at the perimeter wall 11 may further improve the overall appearance of the product.

More specifically, as shown in FIG. 2, the chamfer 112 may be formed on an inner wall 11*d* of the perimeter wall and an end face 11*c* at the second end 11*b* of the perimeter wall 11 that is away from the first end 11*a*. Besides, the chamfer 112 may extend along a circumference of the perimeter wall 11, and the end face 11*c* of the perimeter wall 11 (the front-rear direction as shown in FIGS. 1, 3, and 4) may be smoothly transitioned with the inner wall 11*d* of the perimeter wall 11 by the chamfer 112. In one example of the present disclosure, the chamfer 112 may be a highlighted chamfer.

More specifically, as further shown in FIGS. 2 and 4, the chamfer 112 may include a first edge 112*a* connected to the end face 11*c* and a second edge 112*b* connected to the inner wall 11*d*. A minimum distance from the first edge 112*a* to the circuit board 3 may be greater than a minimum distance from the second edge 112*b* to the circuit board 3.

According to some embodiments of the present disclosure, as shown in FIG. 3, a first stopping plate 12 configured to stop the connection body 2 and a second stopping plate 12 spaced apart from the first stopping plate 13 may be arranged in the housing 1. A part of the connection body 2 may be located between the first stopping plate 12 and the second stopping plate 13. In this way, the connection body 2 may be fixed. It should be noted that, due to operations such as charging and data transmission, the power interface 100 may be frequently used, and the connector may be frequently inserted into or removed from the mobile terminal. Thus, repeated push-pull forces may be generated and applied to the power interface 100, such that failures such as loosening, poor contact and the like may happen to the connection body 2, and the overall performance of the product may be affected. By arranging the first stopping plate 12 and the second stopping plate 13, the connection body 2 may be stably fixed in the housing 1, and thus it is possible to ensure the reliability and the stability of the communication connection between the power interface 100 and the connector.

According to some embodiments of the present disclosure, as shown in FIG. 3, a plurality of first stopping plates 12 and a plurality of second stopping plates 13 may be provided. The plurality of first stopping plates 12 may be spaced apart from each other in the circumferential direction of the housing 1, and the plurality of second stopping plates 13 may be spaced apart from each other in the circumferential direction of the housing 1. In this way, it is possible to further enhance the stability of the connection body 2. As shown in FIG. 3, the first stopping plate 12 and the second stopping plate 13 may be disposed on the inner wall 11*d* of the perimeter wall 11 in form of protrusions. In this case, the first stopping plate 12 may be located in front of the second stopping plate 13, such that a part of the connection body 2 may be fixed between the first stopping plate 12 and the second stopping plate 13. In some embodiments, a pair of first stopping plates 12 distributed in the circumferential direction of the housing 1 may be provided. The pair of first stopping plates 12 may be symmetrical about a center of the perimeter wall 11, and the pair of first stopping plates 12 may be spaced apart from each other. Each first stopping plate 12 may include a front end face 121 that is close to the end face 11*c* of the perimeter wall 11, a first side wall 122 and a second side wall 123 connected to the front end face 121 and the inner wall 11*d* of the perimeter wall 11. The front end face 121 may be a flat plane. Another chamfer may be formed between formed between the first side wall 122 and the second side wall 123, such that the first side wall 122 may be smoothly transitioned with the second side wall 123. The second side wall 123 may also be smoothly transitioned with the inner wall 11*d* of the perimeter wall 11. In this way, it is convenient to connect the power interface 100 with the connector. In some embodiments, the second stopping plate 13 may be made of steel, and the plurality of second stopping plates 13 may be spaced apart from each other in the circumferential direction of the housing 1. Each second stopping plate 13 may also include a front end face, and the front end face of each second stopping plate 13 may also be a flat plane.

According to some embodiments of the present disclosure, as shown in FIG. 14, the end of the connection body 2 that is exposed outside the housing 1 may be located in the middle of the opening 10. In this way, it is conven ent to connect the connector with the power interface 100, thereby ensuring the communication connection between the connector and the power interface. It should be noted that, the power interface 100 may be connected to the connector via an upper surface and a lower surface (the up-down direction as shown in FIGS. 2-4) at the end of the connection body 2. That is to say, the upper surface and the lower surface in this embodiment may be used as connection surfaces that are in contact with the connector when the power interface 100 is connected to the connector. As shown in FIG. 2, the end of the connection body 2 may be disposed in the middle of the opening 10, such that the upper surface and the lower surface configured for the communication connection may be located in the middle of the opening 10. In this way, it is convenient to achieve the communication connection between the connector and the power interface 100, and improve the reliability and stability of the connection between the connector and the power interface 100.

In some embodiments of the present disclosure, as shown in FIG. 4, the power interface 100 may define a screw hole 141, such that the power interface 100 may be stably fixed inside the housing of the mobile terminal. As shown in FIG. 4, a pair of wings 14 may be arranged respectively at the left end and the right end of the power interface 100 (the left-right direction as shown in FIGS. 1-4). Each wing 14 may define the screw hole 141 in order to fix the power interface 100 inside the mobile terminal. Of course, in other embodiments, it is also possible to provided only one wing 14. The number of the wings 14 are not limited in the present disclosure.

According to some embodiments of the present disclosure, as shown in FIG. 1, FIG. 2, FIG. 5, FIG. 6 and FIG. 7, the power interface 100 further may include a plurality of data pins 120 and a plurality of power pins 130, and the first stopping plate 12 and the second stopping plate 13 may be spaced apart from each other in a length direction of each power pin 130. The plurality of data pins 120 may be spaced apart from each other and connected to the connection body 2. The plurality of power pins 130 may also be spaced apart from each other and connected to the connection body 2. The plurality of power pins 130 are spaced apart from the plurality of data pins 120. The plurality of data pins 120 and the plurality of power pins 130 may be exposed outside the connection body 2. More specifically, the plurality of data pins 120 and the plurality of power pins 130 may be exposed out of the upper surface and the lower surface as described above.

At least one of the plurality of power pins 130 may include an expanded portion 132. The expanded portion 132 may have a cross-sectional area greater than that of each of the plurality of data pins 120, in order to increase the current load of the power pin 130. It should be noted that, the power interface 100 may arranged in the mobile terminal, and a battery may be arranged inside the mobile terminal (e.g., a mobile phone, a tablet computer, a notebook computer, etc.). The battery may be charged by the external power source via the power interface 100.

Figure 7:
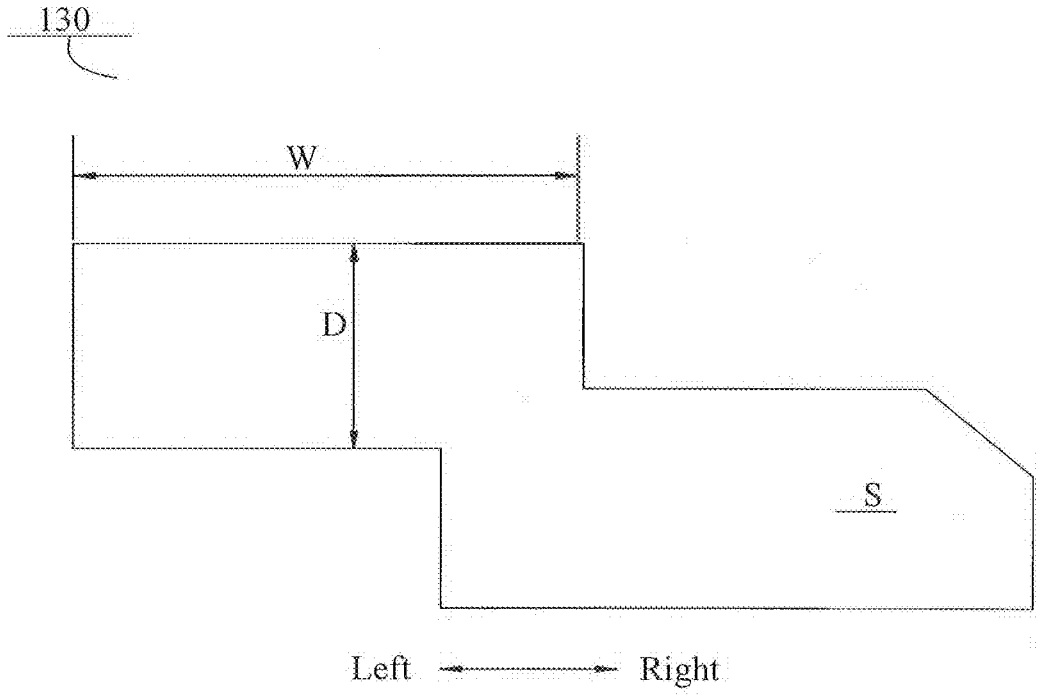
FIG. 7 is a plan view of a power pin of the power interface according to some embodiments of the present disclosure.

According to some embodiments of the present disclosure, as shown in FIG. 7, a cross-sectional area of the expanded portion 132 may be defined as S, and $S \geq 0.09805$ $mm^2$. That is to say, the expanded portion 132 may have a width greater than that of any portion of each of the plurality of data pins 120. It has been experimentally verified that when $S \geq 0.09805$ $mm^2$, the current load of each power pin 130 may be at least 10 A. Therefore, the charging efficiency can be improved by increasing the current load of each power pin 130. After further tests, when $S=0.13125$ $mm^2$, the current load of each power pin 130 may be 12 A or more, which can improve charging efficiency.

According to some embodiments of the present disclosure, as shown in FIG. 7, a thickness of each power pin 130 may be defined as D, and 0.1 m≤D≤0.3 mm. It has been experimentally verified that when 0.1 mm≤D≤0.3 mm, the current load of each power pin 130 is at least 10 A. In this way, it is possible to improve the charging efficiency by increasing the current load of each power pin 130. After further tests, when D=0.25 mm, the current load of each power pin 130 may be greatly increased, and the current load of each power pin 130 is 12 A or more, thereby improving the charging efficiency.

According to some embodiments of the present disclosure, as shown in FIG. 7, each power pin 130 may have a contact surface configured to be electrically connected to the power adapter. In a width direction of each power pin 130 (i.e. the left-right direction shown in FIG. 7), a width of the contact surface may be defined as W, which meets 0.24 mm≤W≤0.32 mm. It has been experimentally verified that when 0.24 mm≤W≤0.32 mm, the current load of each power pin 130 is at least 10 A. In this way, it is possible to improve the charging efficiency by increasing the current load of each power pin 130. After further tests, when W=0.25 mm, the current load of the power pin 130 may be greatly increased, and the current load of the power pin 130 is 12 A or more, thereby improving the charging efficiency.

Referring to FIGS. 1-7, the power interface 100 according to embodiments of the present disclosure is described in details. It is noted that, the following description only is exemplary, and is not limitation to the present disclosure.

For convenience to describe, an example where the power interface 100 is implemented as a Type-C interface is described. The Type-C interface may also be called an USB Type-C interface. The Type-C interface belongs to a type of an interface, and is a new data, video, audio and power transmission interface specification developed and customized by the USB standardization organization to solve the drawbacks present for a long time that the physical interface specifications of the USB interface are uniform, and that the power can only be transmitted in one direction.

The Type-C interface may have the following features: a standard device may declare its willing to occupy a VBUS (that is, a positive connection wire of a traditional USB) to another device through a CC (Configuration Channel) pin in the interface specification. The device having a stronger willing may eventually output voltages and currents to the VBUS, while the other device may accept the power supplied from the VBUS bus, or the other device may still refuse to accept the power; however, it does not affect the transmission function. In order to use the definition of the bus more conveniently, a Type-C interface chip (such as LDR6013) may generally classify devices into four types: DFP (Downstream-facing Port), Strong DRP (Dual Role Power), DRP, and UFP (Upstream-facing Port). The willingness of these four types to occupy the VBUS bus may gradually decrease.

The DFP may correspond to an adapter, and may continuously output voltages to the VBUS. The Strong DRP may correspond to a mobile power, and may give up outputting voltages to the VBUS only when the strong DRP encounters the adapter. The DRP may correspond to a mobile phone. Normally, the DRP may expect other devices to supply power to itself. However, when encountering a device that may have a weaker willingness, the DRP may also output the voltages and currents to the device. The UFP will not output electrical power externally. Generally, the UFP is a weak battery device, or a device without any batteries, such as a Bluetooth headset. The USB Type-C interface may support the insertions both from a positive side and a negative side. Since there are four groups of power sources and grounds on both sides (the positive side and the negative side), the power supported by USB Type-C interface may be greatly improved.

The power interface 100 in this embodiment may be a USB Type-C interface, which may be applied to a power adapter with the fast charging function, or a normal power adapter. Herein, it should be noted that, the fast charging, may refer to a charging state in which a charging current is greater than 2.5 A, or the rated output power is no less than 15 W. The normal charging herein may refer to a charging state in which the charging current is less than or equal to 2.5 A, or the rated output power is less than 15 W. That is, when the power interface 100 is charged by the power adapter with the fast charging function, the charging current is greater than 2.5 A. However, when the power interface 100 is charged by the normal power adapter, the charging current is less than 2.5 A.

More specifically, as shown in FIGS. 1-7, the power interface 100 according to some embodiments of the present disclosure may include a housing 1 and a connection body 2.

In this case, the housing 1 may include a perimeter wall 11 defining an opening 10, and may include a first end 11*a* connected to a circuit board 3. A chamfer 112 may be formed at the perimeter wall 11. The connection body 2 may be disposed in the housing 1, and one end of the connection body 2 may extend out of the housing 1 from the opening 10 and exposed outside the housing 1. The perimeter wall 11 may include a pair of arc sections 110 each in shape of a semi-circle, and the pair of arc sections 110 may be located at two opposite ends of the perimeter wall 11 and spaced apart from each other in a length direction (the left-right direction as shown in FIG. 1) of the power interface 100. Each arc section 110 may be recessed toward an outer side of the opening 10 (the inner-outer direction as shown in FIG. 4). That is to say, a center of curvature of each arc section 110 may be located in the opening 10. The perimeter wall 11 may further include a pair of straight sections 111, and the a pair of straight sections 111 may be respectively connected between the pair of arc sections 110 at two opposite ends of each arc section 110, and may be substantially parallel to each other. A first stopping plate 12 configured to stop the connection body 2 and a second stopping plate 12 spaced apart from the first stopping plate 13 may be arranged in the housing 1. The first stopping plate 12 and the second stopping plate 13 may be disposed on the inner wall of the perimeter wall 11 in form of protrusions. In this case, the first stopping plate 12 may be located in front of the second stopping plate 13, such that a part of the connection body 2 may be fixed between the first stopping plate 12 and the second stopping plate 13. In some embodiments, a pair of first stopping plates 12 distributed in the circumferential direction of the housing 1 may be provided. The pair of first stopping plates 12 may be symmetrical about a center of the perimeter wall 11, and free ends respectively of the pair of first stopping plates 12 may be spaced apart from each other. Each first stopping plate 12 may include a front end face 121 that is close to the end face 11*c* of the perimeter wall 11, a first side wall 122 and a second side wall 123 connected to the front end face 121 and the inner wall 11*d* of the perimeter wall 11. The front end face 121 may be a flat plane. Another chamfer may be formed between formed between the first side wall 122 and the second side wall 123, such that the first side wall 122 may be smoothly transitioned with the second side wall 123. The second side wall 123 may also be smoothly transitioned with the inner wall 11*c* of the perimeter wall 11. In this way, it is convenient to connect the power interface 100 with the connector. The second stopping plate 13 may be made of steel. In some embodiments, a plurality of second stopping plates 13 may be provided, and the plurality of second stopping plates 13 may be spaced apart from each other in the circumferential direction of the housing 1. Each second stopping plate 13 may also include a front end face, and the front end face of each second stopping plate 13 may also be a flat plane.

The mobile terminal according to some embodiments of the present disclosure may include the power interface 100 as described above. The mobile terminal may realize the transmission of electrical signals and data signals via the power interface 100. For example, the mobile terminal may be electrically connected to the power adapter through the power interface 100 to implement a charging or data transmission function.

In some embodiments, the mobile terminal may include a circuit board 3, a housing 1, a connection body 2, a plurality of data pins 120, and a plurality of power pins 130. The housing 1 may include a perimeter wall 11 defining an opening 10. The perimeter wall 11 may include a pair of arc sections 110 located at two ends of the perimeter wall 11 and spaced apart from each other in a length direction. The connection body 2 may be disposed in the housing 1 and configured to be connected to the circuit board 3. One end of the connection body 2 may extend out of the housing 1 from the opening 10 and be exposed outside the housing 1. The plurality of data pins may be connected to the connection body 2 and the circuit board 3. The plurality of power pins 130 may be connected to the connection body 2 and the circuit board 3. The plurality of data pins 120 and the plurality of power pins 130 may be spaced from each other and distributed in a length direction of the connection body 2. At least one of the plurality of power pins 130 may have an expanded portion 132 having a width greater than that of any portion of each of the plurality of data pins 120.

In some embodiments, each of the pair of arc sections 110 may be in shape of a semi-circle, and a center of curvature of each arc section 110 may be located in the opening 10.

In some embodiments, the perimeter wall 11 may further include a pair of straight sections 111 respectively connected between the pair of arc sections 110 at two opposite ends of each arc section 110, and the pair of straight sections 111 may be substantially parallel to each other.

In some embodiments, the housing 1 may include a first end 11*a* connected to the circuit board 3, and a second end 11*b* away from the first end 11*a*. A chamfer 112 may be formed between an inner wall 11*d* of the perimeter wall 11 and an end face 11*c* at the second end of the perimeter wall 11, and the chamfer 112 may extend along a circumference of the perimeter wall 11.

In some embodiments, the mobile terminal may further include a first stopping plate 12 configured to stop the connection body 2 and a second stopping plate 13 spaced apart from the first stopping plate 12 in a length direction of each of the plurality of power pins 130. The first stopping plate 12 and the second stopping plate 13 may be arranged in the housing 1. A part of the connection body 2 may be located between the first stopping plate 12 and the second stopping plate 13.

In the mobile terminal according to some embodiments of the present disclosure, by using the power interface 100 describe above, the connection between the mobile terminal and the connector may be more stable and reliable, and the overall appearance of the product may be improved.

A power adapter according to an embodiment of the present disclosure may include the power interface 100 as described above. The power adapter may realize the transmission of electrical signals and data signals via the power interface 100.

In some embodiments, the power adapter may include a circuit board 3 and a power interface 100 configured to be connected to the circuit board 3. The power interface 100 may include a housing 1 and a connection body 2. The housing 1 may include a perimeter wall 11 defining an opening 10. The perimeter wall 11 may include a pair of arc sections 110 and a pair of straight sections 111. The pair of arc sections 110 may be located at two ends of the perimeter wall 11 and spaced apart from each other in a length direction. The pair of straight sections 111 may be respectively connected between the pair of arc sections 110 at two opposite ends of each arc section 110. The connection body 2 may be disposed in the housing 1 and connected to the circuit board 3. One end of the connection body 2 may extend out of the housing 1 from the opening 10 and be exposed outside the housing 1.

In some embodiments, each of the pair of arc sections 110 may be in shape of a semi-circle, and a center of curvature of each arc section 110 may be located in the opening 10.

In some embodiments, the housing 1 may include a first end 11*a* connected to the circuit board 3, and a second end 11*b* away from the first end 11*a*. A chamfer 112 may be formed between an inner wall 11*d* of the perimeter wall 11 and an end face 11*c* at the second end of the perimeter wall 11, and the chamfer 112 may extend along a circumference of the perimeter wall 11.

In some embodiments, the power adapter may further include a first stopping plate 12 configured to stop the connection body 2 and a second stopping plate 13 spaced apart from the first stopping plate 12 in a length direction of each of the plurality of power pins 130. The first stopping plate 12 and the second stopping plate 13 may be arranged in the housing 1. A part of the connection body 2 may be located between the first stopping plate 12 and the second stopping plate 13. In a further aspect, an electronic device may be further provide. The electronic device may include the power interface 100 as described above. More specifically, in some embodiments, the electronic device may include a circuit board 3 and a power interface 100 configured to be connected to the circuit board 3. The power interface 3 may include a housing 1, and a connection body 2. The housing 1 may include a perimeter wall 11 defining an opening 10. The perimeter wall 11 may include a pair of arc sections 110 located at two ends of the perimeter wall 11 and spaced apart from each other in a length direction. The perimeter wall 11 may further include a pair of straight sections 111 respectively connected between the pair of arc sections 110 at two opposite ends of each arc section 110. The connection body 2 may be disposed in the housing 1. One end of the connection body 2 may extend out of the housing 1 from the opening 10 and be exposed outside the housing 1.

In the power adapter according to some embodiments of the present disclosure, by using the power interface 100 describe above, the connection between the mobile terminal and the connector may be more stable and reliable, and the overall appearance of the product may be improved.

Reference throughout this specification, the reference terms "an embodiment", "some embodiments", "an example", "a specific example", or "some examples", and the like means that a specific feature, structure, material, or characteristic described in connection with the embodiment or example is included in at least one embodiment or example of the present disclosure. Thus, the illustrative descriptions of the terms throughout this specification are not necessarily referring to the same embodiment or example of the present disclosure. Furthermore, the specific features, structures, materials, or characteristics may be combined in any suitable manner in one or more embodiments or examples. In addition, one skilled in the art may combine the different embodiments or examples described in this specification and features of different embodiments or examples without conflicting with each other.

Although explanatory embodiments have been shown and described, it would be appreciated by one skilled in the art that the above embodiments previously described are illustrative, and cannot be construed to limit the present disclosure. Changes, alternatives, and modifications can be made in the embodiments without departing from scope of the present disclosure.

What is claimed is:

1. A power interface, comprising:

a housing, comprising a perimeter wall defining an opening; wherein the perimeter wall comprises a pair of arc sections located at two ends of the perimeter wall and spaced apart from each other in a length direction;

a connection body, disposed in the housing, wherein one end of the connection body extends out of the housing from the opening and is exposed outside the housing;

a plurality of data pins, spaced apart from each other and connected to the connection body; and a plurality of power pins, spaced apart from each other and connected to the connection body;

wherein the plurality of data pins and the plurality of power pins are exposed outside the connection body;

wherein at least one of the plurality of power pins comprises an expanded portion having a cross-sectional area larger than that of each of the plurality of data pins.

2. The power interface of claim 1, wherein each of the pair of arc sections is in shape of a semi-circle.

3. The power interface of claim 1, wherein a center of curvature of each arc section is located in the opening.

4. The power interface of claim 1, wherein the perimeter wall further comprises a pair of straight sections respectively connected between the pair of arc sections at two opposite ends of each arc section, and the pair of straight sections are substantially parallel to each other.

5. The power interface of claim 1, wherein the housing comprises a first end connected to a circuit board, and a second end away from the first end;

a chamfer is formed between an inner wall of the perimeter wall and an end face at the second end of the perimeter wall, and the chamfer extends along a circumference of the perimeter wall.

6. The power interface of claim 5, wherein the chamfer comprises a first edge connected to the end face and a second edge connected to the inner wall;

a minimum distance from the first edge to the circuit board is greater than a minimum distance from the second edge to the circuit board.

7. The power interface of claim 1, further comprising a first stopping plate configured to stop the connection body and a second stopping plate spaced apart from the first stopping plate in a length direction of each of the plurality of power pins; wherein the first stopping plate and the second stopping plate are arranged in the housing; a part of the connection body is located between the first stopping plate and the second stopping plate.

8. The power interface of claim 7, comprising a plurality of first stopping plates and a plurality of second stopping plates; wherein the plurality of first stopping plates are spaced apart from each other in a circumferential direction of the housing, and the plurality of second stopping plates are spaced apart from each other in the circumferential direction of the housing.

9. The power interface of claim 7, wherein the number of the first stopping plate is two, and the two first stopping plates are spaced apart from each other and symmetrical about a center of the perimeter wall.

10. The power interface of claim 9, wherein the housing comprises a first end connected to a circuit board and a second end away from the first end, and the second end comprises a first end face;

each of the two first stopping plates comprises:

a second end face, disposed close to the first end face; and a first side wall and a second side wall, wherein both the first side wall and the second side wall are connected to the second end face and an inner wall of the perimeter wall.

11. The power interface of claim 1, wherein a wing is arranged on the power interface, and the wing defines a screw hole.

12. The power interface of claim 1, wherein the expanded portion has a cross-sectional area S, and the cross-sectional area S satisfies: $S \geq 0.09805\ mm^2$.

13. A mobile terminal, comprising:

a circuit board, a housing, comprising a perimeter wall defining an opening; wherein the perimeter wall comprises a pair of arc sections located at two ends of the perimeter wall and spaced apart from each other in a length direction;

a connection body, disposed in the housing and connected to the circuit board, wherein one end of the connection body extends out of the housing from the opening and is exposed outside the housing;

a plurality of data pins, spaced apart from each other and connected to the connection body; and a plurality of power pins, spaced apart from each other and connected to the connection body;

wherein the plurality of data pins and the plurality of power pins are exposed outside the connection body;

wherein at least one of the plurality of power pins comprises an expanded portion having a cross-sectional area larger than that of each of the plurality of data pins.

14. The mobile terminal of claim 13, wherein each of the pair of arc sections is in shape of a semi-circle, and a center of curvature of each arc section is located in the opening.

15. The mobile terminal of claim 13, wherein the perimeter wall further comprises a pair of straight sections respectively connected between the pair of arc sections at two opposite ends of each arc section, and the pair of straight sections are substantially parallel to each other.

16. The mobile terminal of claim 13, wherein the housing comprises a first end connected to the circuit board, and a second end away from the first end;

a chamfer is formed between an inner wall of the perimeter wall and an end face at the second end of the perimeter wall, and the chamfer extends along a circumference of the perimeter wall.

17. The mobile terminal of claim 16, wherein the chamfer comprises a first edge connected to the end face and a second edge connected to the inner wall;

a minimum distance from the first edge to the circuit board is greater than a minimum distance from the second edge to the circuit board.

18. The mobile terminal of claim 13, further comprising:

a first stopping plate, configured to stop the connection body; and a second stopping plate, spaced apart from the first stopping plate in a length direction of each of the plurality of power pins; wherein the first stopping plate and the second stopping plate are arranged in the housing; a part of the connection body is located between the first stopping plate and the second stopping plate.

19. The mobile terminal of claim 18, comprising a plurality of first stopping plates and a plurality of second stopping plates; wherein the plurality of first stopping plates are spaced apart from each other in a circumferential direction of the housing, and the plurality of second stopping plates are spaced apart from each other in the circumferential direction of the housing.

20. An electronic device, comprising:

a circuit board; and a power interface, configured to be connected to the circuit board and comprising:

a housing, comprising a perimeter wall defining an opening; wherein the perimeter wall comprises:

a pair of arc sections located at two ends of the perimeter wall and spaced apart from each other in a length direction; and a pair of straight sections respectively connected between the pair of arc sections at two opposite ends of each arc section;

a connection body, disposed in the housing and connected to the circuit board, wherein one end of the connection body extends out of the housing from the opening and is exposed outside the housing;

a plurality of data pins, spaced apart from each other and connected to the connection body; and a plurality of power pins, spaced apart from each other and connected to the connection body;

wherein the plurality of data pins and the plurality of power pins are exposed outside the connection body;

wherein at least one of the plurality of power pins comprises an expanded portion having a cross-sectional area larger than that of each of the plurality of data pins.

* * * * *